US005939337A

United States Patent [19]

Hatakeyama et al.

[11] Patent Number: 5,939,337

[45] **Date of Patent: *Aug. 17, 1999**

[54] TONER FIXATION FILM AND TONER FIXATION APPARATUS USING IT

[75] Inventors: Hideyuki Hatakeyama, Yokohama; Hiroaki Kumagai, Yonago; Kazuo Kishino, Kawasaki; Masaaki Takahashi, Asaka; Hideo Kawamoto, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/691,713

[22] Filed: Aug. 2, 1996

[30] Foreign Application Priority Data

Aug. 3, 1995 [JP] Japan ..... 7-198395
Nov. 22, 1995 [JP] Japan ..... 7-304401

[51] Int. Cl.[6] ..... D03D 15/00

[52] U.S. Cl. ..... 442/6; 442/16; 442/52; 428/692; 428/900; 399/335; 399/338

[58] Field of Search ..... 428/692, 900; 442/6, 16, 52; 399/335, 338

[56] References Cited

U.S. PATENT DOCUMENTS

| | | | |
|---|---|---|---|
| 4,313,777 | 2/1982 | Buckley et al. | 156/272 |
| 4,463,034 | 7/1984 | Tokunaga et al. | 427/256 |
| 5,471,288 | 11/1995 | Ohtsuka et al. . | |
| 5,568,240 | 10/1996 | Ohtsuka | 355/285 |

FOREIGN PATENT DOCUMENTS

| | | |
|---|---|---|
| 62-150371 | 7/1987 | Japan . |
| 5-9027 | 2/1993 | Japan . |

*Primary Examiner*—Christopher Raimund
*Attorney, Agent, or Firm*—Fitzpatrick, Cella, Harper & Scinto

[57] ABSTRACT

A toner fixation film has an exothermic layer within which an eddy current is induced with application of a magnetic field and then heat is generated. The exothermic layer is a composite layer in which an exothermic part and resin part coexist. The toner fixation film can offer a sufficient heat generation necessary for toner fixation, and has enough flexiblity to permit curvature separation. A toner fixation apparatus comprises the toner fixation film and at least one coil for producing an alternating magnetic field for eddy current induction.

14 Claims, 3 Drawing Sheets

TONER FIXATION FILM AND TONER FIXATION APPARATUS USING IT

BACKGROUND OF THE INVENTION

1. Field of the Invention

The present invention relates to a fixation film for fixing toner using heat generated by inducing an eddy current with electromagnetic induction. More particularly, this invention relates to a fixation film suitable for a toner fixing apparatus for fixing toner, which is employed in an image formation apparatus such as an electrophotographic apparatus and electrostatic recording apparatus. The present invention also relates to a toner fixation apparatus using the above fixation film.

2. Related Background Art

Contact heating systems such as a heat roller system and a film heating system have been widely used as a heating system represented by a toner fixation apparatus.

Among the toner fixation apparatuses, the color toner fixation apparatus which fixes four toner layers at maximum uses a halogen heater as a heat generator to heat the toner image via the core metal and the elastic rubber layer of a fixing roller.

Japanese Patent Publication No. 5-9027 has discloses a heating method utilizing Joule heat caused by an eddy current induced by a magnetic flux within a fixation roller.

When heat is generated by eddy current induction, the heat generation site can be made close to the toner. Thus, the energy consumption efficiency can be greatly improved in comparison with a heat roller using a halogen lamp.

However, according to the method taught in Japanese Patent Publication No. 5-9027, even the most efficient fixation roller cannot achieve quick start since a fixation roller having a large heat capacity is heated. In that case, since the temperatures of the exciting coil and the exciting iron core are also raised, the amount of magnetic flux is decreased and heat generation becomes unstable. Furthermore, heat efficiency is not satisfying because of the heat dissipation into the roller.

In an effort to overcome the foregoing problems, a method of inducing an eddy current within a metallic film and thus generating Joule heat has been proposed recently. However, the method using the metallic film has a limit in heat generation capacity. If the metallic film is made thicker in order to increase the heat generation, the metallic film becomes very rigid, so that, when the metallic film is used as a fixation film, problematically the fixation film can not be curved to enable "curvature separation," that is, separation of the fixation film from a recording material (or transfer material) by increasing curvature.

SUMMARY OF THE INVENTION

An object of the present invention is to provide a toner fixation film which can generate sufficient heat necessary for toner fixation, and is flexible enough to permit curvature separation.

Another object of the present invention is to provide a toner fixation apparatus using the above fixation film.

According to the present invention, there is provided a toner fixation film having an exothermic layer in which an eddy current is induced by a magnetic field so as to generate heat, wherein the exothermic layer is a composite layer of an exothermic part and resin part.

Moreover, according to the present invention, there is provided a toner fixation apparatus in which a fixation film is in press-contact with a pressing member, at least one coil is provided for generating an alternating magnetic field to induce an eddy current in the exothermic layer of the fixation film in the magnetic field, where a recording material holding an unfixed toner image thereon is held and transported between the fixation film and pressing member for toner fixation, which exothermic layer is a composite layer of an exothermic part and resin part.

In the toner fixation film of the present invention, the exothermic layer is a composite layer in which an exothermic part and a resin part are mixedly present. The heat generation can be increased by increasing the thickness of the exothermic part or by increasing the amount of the exothermic part. Even when the thickness or amount of the exothermic part is increased, excellent flexibility is ensured, since the exothermic part is not a continuous layer like a metallic plate, but is mixedly present with the resin part. Consequently, the toner fixation film is suitable for curvature separation.

DESCRIPTION OF THE PREFERRED EMBODIMENTS

Figure 1:
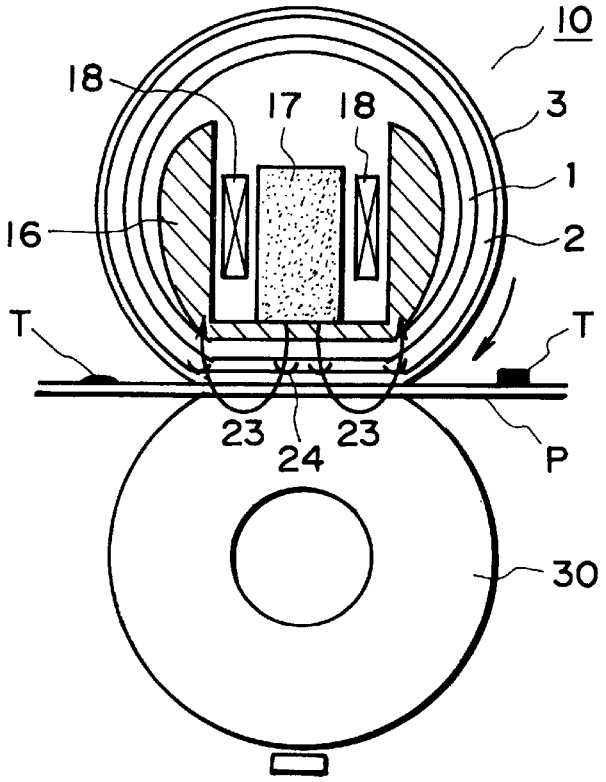
FIG. 1 is a schematic sectional view showing the major portion of a toner fixation apparatus of the present invention.

The exothermic layer of a fixation film in accordance with the present invention is a composite layer of an exothermic part and a resin part, i.e. the exothermic part and the resin part are mixedly present. A preferable exothermic part is a metallic web or magnetic fine particles. In the case of a metallic web, the resin part exists among metallic fibers constituting the metallic web. In the case of magnetic fine particles, the magnetic particles are dispersed in the resin part.

To begin with, the metallic web will be described. The metallic web is a web made of a metal such as iron, nickel, cobalt, and the like, excellent in absorption of magnetic flux. Compared with a metallic film, the metallic web can provide a fixation film of low rigidity and sufficient heat generation ability. Low rigidity of a fixation film makes curvature separation easy.

The above metallic web can be layered in two layers or more. When metallic web layers made of stainless steel, iron, nickel, cobalt, or the like are laminated, electromagnetic energy is absorbed more efficiently and the heat generation tends to increase. When a metallic film is used as an exothermic layer, a film thicker than the skin depth given by the following general expression can absorb more electromagnetic energy and can generate more heat.

$$\sigma=503\times(\rho/f\mu)^{1/2} \quad \text{(I)}$$

where $\sigma$ is a skin depth (m), f is a frequency of an excitation circuit (Hz), $\rho$ is a specific resistance ($\Omega$m), and $\mu$ is a magnetic permeability.

However, if the metallic film is thicker than 100 $\mu$m, the rigidity of the film itself becomes so high that the film flexibility lowers making curvature separation difficult, and it is impractical to be used as a rotating member.

By contrast, when a metallic web is used, since the rigidity of the metallic web itself is very low, even when metallic webs are laminated, the flexibility of the resultant film will not become lower than the practical level. Hence, by using two or more layers of laminated metallic webs as an exothermic layer it is provided a fixation film which enables both increased heat generation and curvature separation.

Preferably, the opening size of the metallic web ranges from 50 to 600 mesh. The metallic web of 50 mesh or more has enough flexibility to be used as a rotating member, and also its opening size is not large enough for the magnetic flux generated by an exciting coil to pass through the spaces between the metallic wires, which avoids loss and results in high heat generation efficiency.

When the opening size is not over 600 mesh, the thickness of the metallic web is not less than 20 $\mu$m, and the thickness thereof is equal to or larger than the so-called skin depth in the metallic film, which increases heat generation.

When webs of 600 mesh or more are laminated to increase the heat generation, a considerable number of layers are needed to obtain necessary heat for fixation, resulting in poor cost performance.

When the metallic web is used as an exothermic layer of a fixation film, it is necessary to provide on the web a toner release layer made of a fluororesin (PTFE, PFA, FEP, or the like), fluoro-rubber, fluoro-silicone rubber, silicon resin, silicone rubber, or the like. The presence of the toner release layer can prevent occurrence of so-called toner offset phenomenon, a phenomenon that the toner on a recording material is transferred to the fixation film.

In this case, it is preferable that the component(s) of the release layer constitutes the resin part which is filling the metallic web. Such a constitution where the metallic web is bound by the component (resin or rubber) of the release layer improves the strength of the fixation film, prevents the fixation film from unnecessary stretching, and effectively holds the laminated metallic web integrally.

A heat-resistant elastic layer made of a silicone rubber, fluoro-rubber, or the like may be interposed between the metallic web and release layer. For printing a color image, especially a photographic picture, a solid image is formed over a large area of a recording material. In such a case, if the surface of the fixation film fails to follow the irregularity of the recording material or the toner layer, uneven heating takes place, which results in uneven glossiness in the image since where receives more heat becomes more glossy and where receives less heat becomes less glossy.

For preventing uneven glossiness in an image, it is effective to provide an elastic layer in the fixation film. The elasticity due to the elastic layer enables the heating surface of the fixation film to follow the irregularity of the recording material or the toner layer, to avoid uneven glossiness.

When printing a color image, it is preferable to provide an elastic layer between the metallic web and toner release layer. In this case, it is preferable that the component of the elastic layer constitutes the resin part to fill the metallic web. By taking such a constitution, the metallic web is in a state bound by the component of the elastic layer, so that the fixation film has improved strength and can attain uniform glossiness in a color image.

The thickness of the release layer ranges preferably from 1 to 100 $\mu$m. If the thickness of the release layer is less than 1 $\mu$m, the release layer would be worn down during use, and the release effect for toner would deteriorate drastically to cause offset of the toner.

If the release layer is thicker than 100 $\mu$m, the heat insulating effect of the resin and rubber, the components of the elastic layer, prevents efficient transfer of calories generated from the metallic web to the boundary of the recording material and the toner.

The thickness of the elastic layer preferably ranges from 50 to 1000 $\mu$m. If the thickness of the elastic layer is less than 50 $\mu$m, the heating surface of the fixation film would fail to follow the irregularity of the recording material or the toner. Consequently, uneven glossiness would occur in a color image. If the layer thickness exceeds 1000 $\mu$m, it is hard to efficiently transfer the heat generated from the metallic web to the boundary of the recording material and the toner because of the insulation effect of the component of the elastic layer.

The hardness of the elastic layer is preferably 60° or less (JIS-A). If the hardness is more than 60°, there is no effect of employing the elastic layer, that is, the heating surface of the fixation film can not follow the irregularity of the recording material or toner, resulting in uneven glossiness in a color image. Also if the hardness of the elastic layer exceeds 60° (JIS-A), the rigidity of the film itself becomes high and curvature separation becomes difficult. More preferably, especially for printing a color image, the hardness of the elastic layer is 30° or less (JIS-A).

The heat conductivity $\lambda$ of the elastic layer is preferably in a range from $6\times10^{-4}$ to $1.5\times10^{-3}$ cal/cm·sec·deg. If the heat conductivity is less than $6\times10^{-4}$ cal/cm·sec·deg, efficient transfer of heat generated by a metallic web to the boundary of the recording material and the toner. If the heat conductivity exceeds $5\times10^{-3}$ cal/cm·sec·deg, the hardness of the elastic layer would become quite high, and uneven glossiness would occur in a color image.

A slippery resin layer may be formed on the inward surface (the surface which does not touch the recording material) of a fixation film having the aforesaid structure. If the resin layer is not provided on the surface of the metallic web side, the fixation film and an inside film guide which supports the film from the inside may be worn down because of the friction between the film guide and the inward surface of the fixation film, which may leads to trouble in recording material transportation, and thus to image defects. This phenomenon is especially notable in a high-speed image formation apparatus.

Therefore, it is effective to provide a slippery resin layer made of a fluororesin, polyimide resin, silicone resin, or the like on the inward surface of the fixation film of the invention. This makes it possible to suppress the abrasion of the fixation film and the film guide.

Next, it will be explained a toner fixation film of which exothermic part in the exothermic layer is magnetic fine particles.

Magnetic fine particles are preferably magnetic fine particles of nickel, iron, stainless steel, cobalt, or any other magnetic substances having excellent flux absorbency. This kind of magnetic fine particles having excellent flux absorbency are mixed with a resin material to form an exothermic layer.

The content of magnetic fine particles in the resin material is preferably in the ratio of the resin to the magnetic substance ranges of from 100:50 to 100:300 (by weight). If the content of magnetic fine particles is too large, the adhesivity of the exothermic layer becomes low when a release layer is provided, and also the elastic properties would deteriorate when a low-rigidity resin material having the elasticity as described below is used for the exothermic layer.

For preparing an exothermic layer while maintaining the original nature of the resin material, it is useful to mix whisker-like fine particles coated with a magnetic substance or fibrous magnetic particles to the resin material.

Here, the whisker-like fine particles coated with a magnetic substance are preferably made by coating the surfaces of whisker-like fine particles of potassium titanate, titanium oxide, barium sulfate, or the like with nickel, iron, cobalt, or any other substance having good flux absorbency by plating or carbonyl process.

When such whisker-like magnetic fine particles are employed, the whisker-like fine particles are tangled with each other within the resin material. Addition of a small amount of whisker-like magnetic fine particles can make a resin material into an exothermic layer thus maintaining the intrinsic properties of the resin material.

The whisker-like fine particles coated with a magnetic substance may be used singly or in combination with other magnetic fine particles.

Fibrous magnetic fine particles have a much larger aspect ratio than normal (spheric, whisker-like, or scale-like) magnetic fine particles. The fibers are therefore tangled closely with each other in the resin material. Consequently, the addition of a smaller amount of fibrous magnetic fine particles can make a resin material into an exothermic layer thus maintaining the intrinsic properties of the resin material.

The fibrous magnetic fine particles may be used singly or in combination with other magnetic substances.

Fibrous particles coated with a magnetic substance may be used as magnetic fine particles with the same or more excellent advantages compared with the foregoing fibrous magnetic fine particles.

Here, the fibrous fine particles coated with a magnetic substance are preferably those fiber-like non-magnetic fine particles such as carbon fiber coated with nickel, cobalt, iron, or any other substance having good flux absorbency by plating or carbonyl process.

In this case, if a carbon fiber or any other substance that is lighter than a magnetic metal is used as core fiber, an apparent concentration of fibrous fine particles in the resin material can be raised.

Fibrous fine particles coated with a magnetic substance may be used singly or in combination with other magnetic fine particles.

A resin material used for an exothermic layer is not particularly limited to any specific material so long as the material employed is heat-resistant, but a resin material of low rigidity is preferable. For example, a polyimide resin, polyether sulfon-resin, polyether ketone resin, polyether imide resin, polyamide-imide resin, silicone resin, fluorine resin, and the like are usable. A low-rigidity resin material having elasticity may be also used. Using any of these resin materials, uneven heating or uneven glossiness caused when a fixing film of which heating surface (e.g. release layer) cannot follow the surface irregularity of the recording material or toner layer can be suppressed.

As the low-rigidity resin material having elasticity, a heat-resistant rubber made of a silicone rubber, fluoro-rubber, fluoro-silicone rubber, or the like is preferable.

The thickness of the exothermic layer can be set within an ordinary range. When a resin material having elasticity is used, the thickness thereof should preferably be 50 $\mu$m or more.

When a low-rigidity resin material is used for the substrate layer as well as for the exothermic layer, excellent curvature separation can be attained.

The volume resistivity of the exothermic layer preferably ranges from 1 to $1\times10^9$ Ω·cm. More preferably, the volume resistivity thereof ranges from $1\times10^3$ to $1\times10^6$ Ω·cm. Using an exothermic layer having a volume resistivity of $1\times10^9$ Ω·cm or smaller, eddy current which is induced in the exothermic layer by a magnetic flux generated by a current application to the exciting coil becomes larger in comparison with one having a volume resistivity of $1\times10^9$ Ω·cm or larger, thus a larger heat generation by electromagnetic induction.

In order to lower the volume resistivity of an exothermic layer to $1\times10^9$ Ω·cm or smaller, a method of adding a conductive filler such as carbon or tin oxide or a method of adding a surfactant is generally adopted.

A toner fixation film preferably has a release layer on the outward surface (the surface which is brought in contact with the recording material and toner).

EXAMPLE 1

Figure 7:
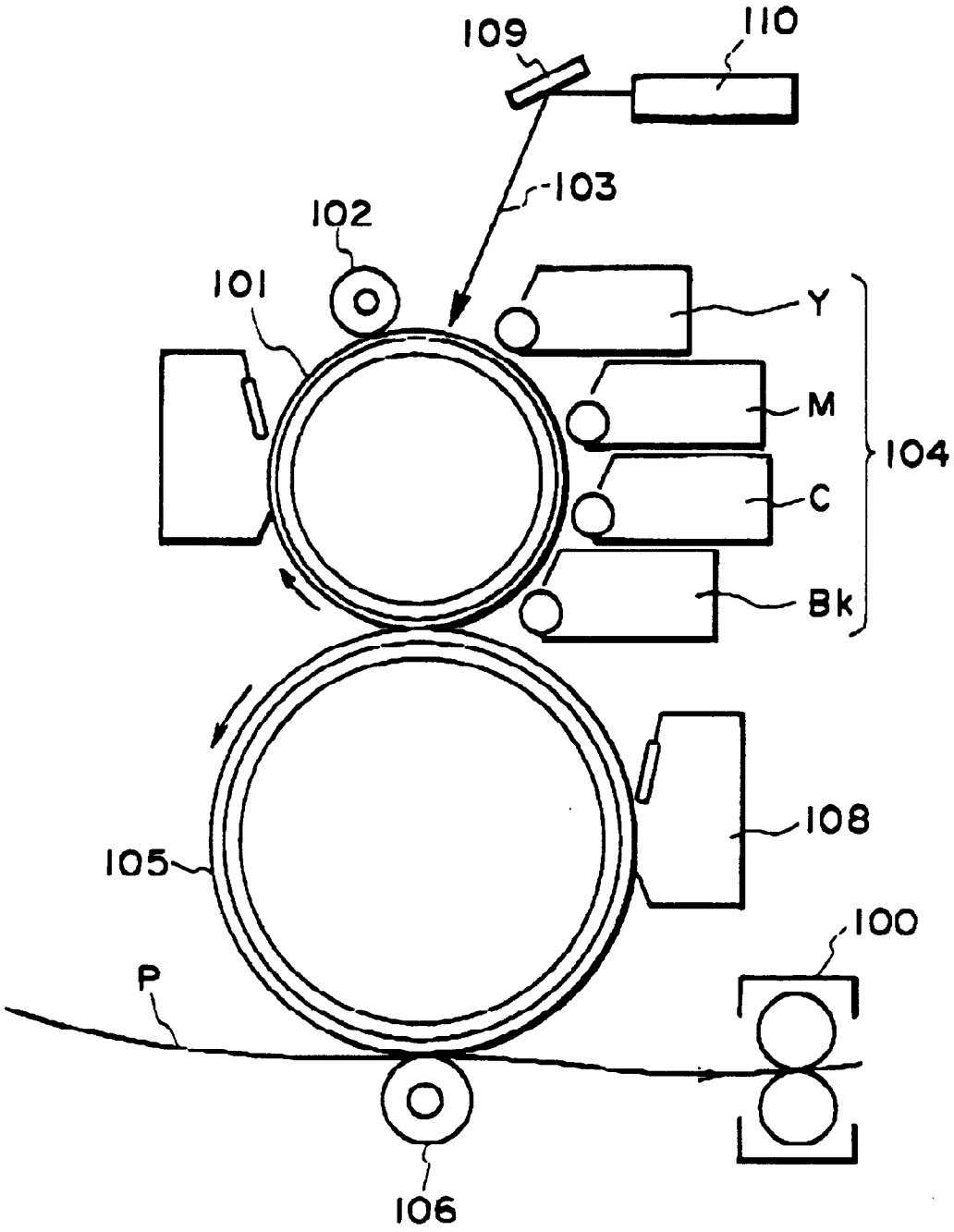
FIG. 7 is a schematic sectional view showing the structure of an image formation apparatus employed in Example 1.

FIG. 7 is a sectional diagram of an electrophotographic color printer using the present invention. Reference numeral 101 denotes a photosensitive drum comprised of an organic photosensitive member or an amorphous silicon photosensitive member, numeral 102 a charging roller for uniformly charging the photosensitive drum 101, and 110 a laser optical box for converting image signals sent from an image signal generating apparatus (not shown) into on/off of laser light to form a latent image on the photosensitive drum 101. Reference numeral 103 denotes laser light, and 109 denotes a mirror.

An electrostatic latent image formed on the photosensitive drum 101 is visualized by selective adhesion of the toner using a developing apparatus 104. The developing apparatus 104 is composed of color developers corresponding to yellow (Y), magenta (M), and cyan (C) and black (Bk). The latent images on the photosensitive drum 101 are developed color by color. Resultant toner images are laminated successively on an intermediate transfer drum 105, whereby a color image is produced.

The intermediate transfer drum 105 is a metallic drum having a medium-resistivity elastic layer and a high-resistivity surface layer. A bias is applied to the metallic drum to form a potential difference between the intermediate transfer drum 105 and the photosensitive drum 101 for toner image transfer. A recording material P supplied from a paper feed cassette by feed rollers is advanced into a nip between a transfer roller 106 and the intermediate transfer drum 105 synchronously with an electrostatic latent image on the photosensitive drum 101.

The transfer roller 106 transfers toner images on the intermediate transfer drum 105 to the recording medium by supplying a charge of an polarity opposite to that of the toner from the back of the recording material P. Then heat and pressure are applied to the recording material holding an unfixed toner images by a heating fixation apparatus 100. The toner images are fixed permanently to the recording material and discharged into a paper discharge tray (not shown). Toner particles and paper dust remaining on the photosensitive drum 101 are removed by a cleaner 108. The photosensitive drum repeats the process succeeding charging.

An image heating apparatus of this example is described below.

(1) Overall configuration of an image heating apparatus (See FIG. 1)

FIG. 1 is a sectional diagram of a fixation apparatus in accordance with the present invention. A fixation film 10 is rotated in the direction of an arrow. A film guide 16 is designed to apply pressure to a nip (not shown) and to stabilize the film.

The film guide 16 also works to support a core 17 of high magnetic permeability and coils 18. The core 17 is preferably made of a material used for a core of a transformer, such as, a ferrite or Permalloy, more preferably, a ferrite capable of minimizing eddy-current loss when the frequency is 100 kHz or higher.

An excitation circuit (not shown) is connected to the coils 18. The circuit generates a high frequency of from 20 to 500 kHz using a switching power source. The recording material P holding unfixed toner T is advanced into a nip between a pressure roller 30 and the fixation film 10, whereby heating fixation is carried out.

The principles of heating at the nip as shown in FIG. 1 are as follows:

Magnetic fluxes generated by current application to the coils are led through the high-permeability core 17 to the nip, and induce an eddy current 24 around magnetic fluxes 23 within an exothermic layer 1 of the fixation film 10. Heat is generated by the eddy current 24 and the specific resistance of the exothermic layer 1.

The generated heat heats the toner T and the recording medium P advanced to the nip, via an elastic layer 2 and release layer 3. At the nip, the toner T is melted, and after passing through the nip, the toner T is cooled down to form a permanent fixed image.

Figure 2:
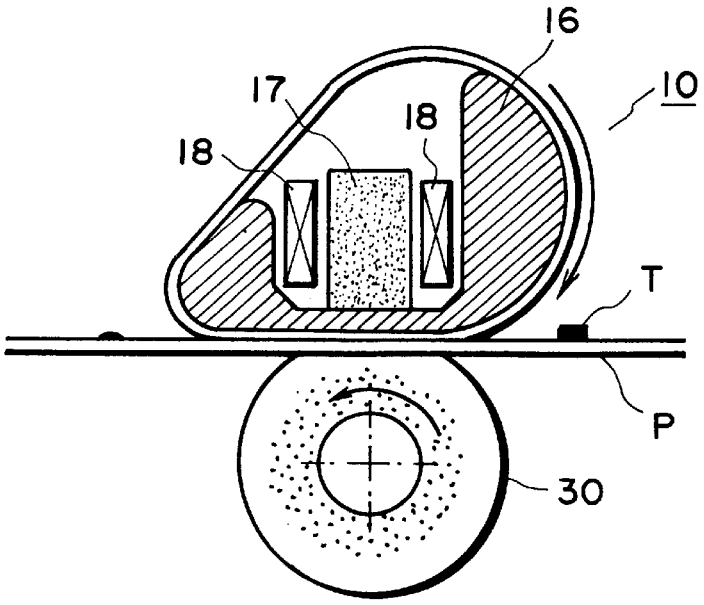
FIG. 2 is a schematic sectional view showing the major portion of a toner fixation apparatus enabling curvature separation.

FIG. 2 is a sectional diagram of a fixation apparatus enabling curvature separation of the recording material P. The fixation film 10 of low rigidity is in contact with the pressing roller 30 in the form shown in FIG. 2. Thus, curvature separation of the recording material P can be achieved.

(2) Pressing roller

Reference numeral 30 denotes a pressing roller comprising a mandrel of which outer circumference is covered with an elastic layer made of a silicone rubber or fluoro-rubber having excellent heat resistivity. The elastic layer may be coated with a resin having excellent toner release ability, such as a fluororesin, silicon resin, or the like. In this Example, the outer circumference of the mandrel is covered with a silicone rubber.

(3) Fixation film constitution

Figure 3:
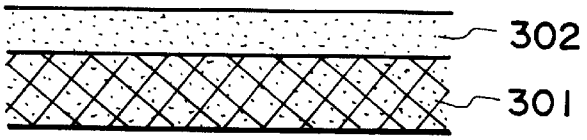
FIG. 3 is a schematic sectional view showing the structure of a fixation film employed in Examples 1, 2, and 4 to 9.

Reference numeral 10 denotes a fixation film of the present invention. The structure of a fixation film (10*a*) in Example 1 is shown in FIG. 3.

Reference numeral 301 denotes a stainless steel web serving as a substrate and exothermic layer of the fixation film. The opening size of the stainless steel web is 100 mesh. The diameter of each stainless wire constituting the web is 0.1 mm. The thickness of the stainless steel web itself is 200 μm.

Reference numeral 302 denotes a toner release layer made of a fluororesin (FEP). The thickness of the layer is 5 μm.

The stainless steel web 301 and the toner release layer 302 are attached to each other using a fluororesin primer. The stainless steel web was impregnated with the same FEP as used for the toner release layer.

A fixation test was carried out using the fixation film 10*a*set on the image heating apparatus shown in FIG. 2. The result is shown in Table 1.

TABLE 1

| | Components of fixation film | | | Assessment of performance in actual use | |
|---|---|---|---|---|---|
| | Substrate | Thickness of substrate | Release layer | Magnitude of heat generation | Curvature separation |
| Example 1 | Stainless steel web (100 mesh, diameter of wire: 0.1 mm) | 200 μm | FEP 15 μm | A | A |
| Example 2 | Nickel web (100 mesh, diameter of wire: 0.1 mm) | 210 μm | FEP 15 μm | A | A |
| Comparative Example 1 | Stainless steel film (material 304) | 50 μm | FEP 15 μm | A | B |

With the fixation film 10*a*, the same heat generation level was obtained as with a fixation film using a stainless steel (SUS 304) film of 50 μm thick as a substrate (Comparative Example 1). Since the fixation film 10*a* has a stainless steel web as the substrate the rigidity of the film was very low and curvature separation is easily done. The fixation film of Comparative Example 1 not using the stainless steel web is inferior in curvature separation a little.

As mentioned above, the employment of the fixation film 10*a* makes it possible to provide an image heating apparatus capable of quick start, energy saving and easy curvature separation.

In Table 1 and subsequent Examples, criterion A for heat generation means that the surface temperature of the fixation film reaches 200° C. within one minute; criterion A for curvature separation means that no winding of A4-size recording paper to the fixation film occurred during 1000 sheet operation; and criterion B for curvature separation means that 5–10 sheets of A4-size recording paper were wound to the fixation film during 1000 sheet operation.

EXAMPLE 2

In Example 2, the fixation film 10*a* also had the constitution shown in FIG. 3.

Reference numeral 301 denotes a nickel web serving as a substrate and exothermic layer of the fixation film.

The opening size of the nickel web is 100 mesh. The diameter of each nickel wire constituting the web is 0.1 mm. The thickness of the nickel web itself is 210 μm.

Reference numeral 302 denotes a toner release layer made of a fluororesin (FEP). The thickness of the layer is 15 μm.

The nickel web 301 and toner release layer 302 are attached to each other using a fluororesin primer. The nickel web was impregnated with the same FEP as used for the toner release layer.

A fixation test was carried out using the fixation film 10*a* set on the image heating apparatus shown in FIG. 2. As a result, almost the same heat generation level was acquired as with the film using stainless steel web as the substrate layer, and since the rigidity of the web itself was very low, the same easy curvature separation could be achieved as with the film using a stainless steel web.

EXAMPLE 3

Figure 4:
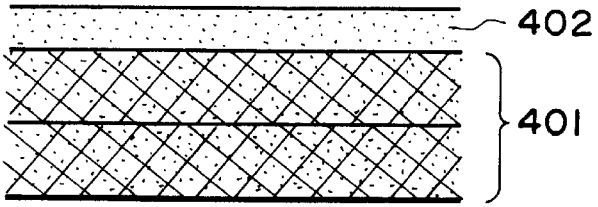
FIG. 4 is a schematic sectional view showing the structure of a fixation film employed in Example 3.

FIG. 4 shows the constitution of a fixation film 10*b* of Example 3. Reference numeral 401 denotes a stainless steel web serving as a substrate and exothermic layer of the fixation film. Two layers of stainless steel web are laminated. The opening size of each stainless steel web is 100 mesh. The diameter of each stainless steel wire constituting the web is 0.1 mm. The thickness of one layer of a stainless steel web is 200 μm. The total thickness of laminated stainless steel webs is 400 μm.

Reference numeral 402 denotes a toner release layer made of a fluororesin (FEP). The thickness of the layer is 15 μm.

The stainless steel webs 401 and toner release layer 402 are attached to each other using a fluororesin primer. The stainless steel webs includes the same FEP as used for the toner release layer. Owing to this constitution, the first layer and the second layer of stainless web can be integrated.

A fixation test was conducted using the fixation film 10*b* where the fixation film was set on the image heating apparatus shown in FIG. 2. The result is shown in Table 2.

fixation film 10*b* of this example was equivalent to that of the fixation film using a stainless steel film (SUS 304 and 90 μm thick) as a substrate.

When a stainless steel film (SUS 304, and of 90 μm thick) was used as a substrate, higher heat generation was obtained, but the rigidity of the fixation film was very high, and therefore good curvature separation was hard to attain.

When the fixation film 10*b* of this example was used, a higher level of heat generation could be obtained and at the same time, since the rigidity of the stainless steel web was so low that the rigidity of the fixation film was not great even when two layers of such stainless steel webs were laminated. Good curvature separation could therefore be attained readily.

As mentioned above, the employment of the fixation film 10*b* makes it possible to provide an image heating apparatus which enables quick start and energy saving at a higher level, as well as easy curvature separation.

In Table 2 and subsequent Examples, criterion AA for heat generation level means that the temperature of the fixation film reaches 200° C. within 30 sec.; and criterion C for curvature separation means that a sheet of A4-size paper was wound to the fixation film within one to five sheet operation after the start of paper feeding.

EXAMPLES 4 to 9

Studies were made on the relationship between the opening size of a metallic web and the heat generation level and curvature separation, as well as the cost of a fixation film.

TABLE 2

| | Components of fixation film | | | | Assessment of performance in actual use | |
|---|---|---|---|---|---|---|
| | Substrate | No. of layers | Thickness of substrate | Release layer | Magnitude of heat generation | Curvature separation |
| Example 3 | Stainless steel web (100 mesh, diameter of wire: 0.1 mm) | 2 | 400 μm in total | FEP 15 μm | AA | A |
| Comparative Example 2 | Stainless steel film (material: SUS304) | 1 | 90 μm | FEP 15 μm | AA | C |

With the fixation film 10*b*, the heat generation level was higher than the fixation film of Example 1 having only one stainless steel web layer. The heat generation level of the Table 3 lists the components of fixation films employed in Examples 4 to 9 and the fixation test results with fixation films set on an image heating apparatus.

TABLE 3

| | Components of fixation film | | | | | performance in actual use | | |
|---|---|---|---|---|---|---|---|---|
| | Substrate (stainless steel web) | | | | | | | |
| | No. of mesh | Diameter (mm) | Thickness (μm) | No. of layers | Release layer thickness | heat generation | Curvature separation | Cost |
| Example 4 | 40 | 0.160 | 310 | 1 | FEP 15 μm | B | B | Low |
| Example 5 | 50 | 0.140 | 280 | 1 | FEP 15 μm | A | A | Low |
| Example 1 | 100 | 0.010 | 200 | 1 | FEP 15 μm | A | A | Low |
| Example 3 | " | " | " | 2 | FEP 15 μm | AA | A | Low |
| Example 6 | 200 | 0.050 | 110 | 1 | FEP 15 μm | A | A | Low |
| Example 7 | " | " | " | 2 | FEP 15 μm | AA | A | Low |

TABLE 3-continued

| | Components of fixation film | | | | | performance in actual use | | |
|---|---|---|---|---|---|---|---|---|
| | Substrate (stainless steel web) | | | | | | | |
| | No. of mesh | Diameter (mm) | Thickness (μm) | No. of layers | Release layer thickness | heat generation | Curvature separation | Cost |
| Example 8 | 400 | 0.023 | 54 | 3 | FEP 15 μm | A | A | Low |
| Example 9 | 600 | 0.020 | 20 | 5 | FEP 15 μm | B | A | High |

When a single layer of 40 mesh stainless steel web was used as the substrate of a fixation film (Example 4), the rigidity of the stainless steel web was so high that the fixation film was not suitable for a rotator. When the fixation film was mounted on the image heating apparatus, curvature separation became difficult.

In addition, a distance between stainless steel wires constituting the web was so large that magnetic flux pass through between them. This resulted in less heat generation and poor energy efficiency.

When a 600 mesh stainless steel web is used as the substrate of a fixation film, the thickness of the stainless steel web layer is as small as 20 μm and smaller than the skin depth in a metallic film. Thus the stainless steel web cannot absorb magnetic flux and heat generation is decreased.

In an effort to solve this problem, five layers of 600 mesh stainless steel web were laminated as the substrate of a fixation film and tested (Example 9), but sufficient heat generation could not be obtained. Moreover, as the number of layers of metallic web to be laminated increases, the cost of the fixation film rises. Even from this viewpoint, the use of a metallic web of 600 mesh or more is not best for the substrate of a fixation film.

When a stainless steel web of 50 mesh (Example 5), one of 100 mesh (Example 1), or one of 200 mesh (Example 6) was used as the substrate of a fixation film, the fixation films satisfied all criteria on the heat generation, curvature separation, and the cost.

When two layers of stainless steel web of 100 mesh (Example 3), two layers of stainless steel web of 200 mesh (Example 7), and three layers of stainless steel web of 400 mesh (Example 8) were laminated, compared with the fixation film having a single layer of each stainless steel web, they achieved higher heat generation and energy efficiency, and also satisfied the criteria on curvature separation and cost.

In consideration of the aforesaid results of the test, the opening size of the metallic web preferably ranges from 50 to 600 mesh. When a metallic web of this mesh range is used as the substrate of a fixation film, a fixation film and image heating apparatus enables quick start, energy saving and easy curvature separation of the recording material.

In Table 3 and subsequent Examples, criterion C for heat generation means that the fixation temperature of the fixation film reaches 200° C. within one to two min.

EXAMPLE 10

Figure 5:
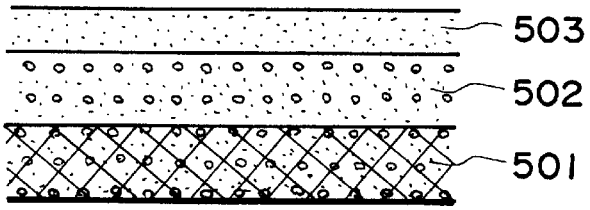
FIG. 5 is a schematic sectional view showing the structure of a fixation film employed in Examples 10 to 20.

FIG. 5 shows the constitution of a fixation film 10*c* of Example 10. Reference numeral 501 denotes a stainless steel web serving as a substrate and exothermic layer of the fixation film. The opening size of the stainless steel web is 100 mesh. The diameter of each stainless steel wire constituting the web is 0.1 mm. The thickness of the stainless steel web itself is 200 μm.

Reference numeral 502 denotes an elastic layer made of a silicone rubber (hardness of rubber: 30° (JIS-A), heat conductivity: $1\times10^{-3}$ cal/cm·sec·deg.). The thickness of the elastic layer is 100 μm. The stainless steel web 501 and elastic layer 502 are attached to each other using a silicone rubber primer. The stainless steel web was impregnated with the silicone rubber used for the elastic layer followed by curing.

Reference numeral 503 denotes a toner release layer made of a fluororesin (FEP). The thickness of the layer is 15 μm. The elastic layer 502 and release layer 503 are attached to each other using a primer.

A fixation test using the fixation film 10*c* was conducted where the film was set on the image heating apparatus shown in FIG. 2. The result is shown in Table 4.

TABLE 4

| | Components of fixation film | | | Assessment of performance in actual use | | |
|---|---|---|---|---|---|---|
| | Substrate | Elastic layer | Release layer | heat generation | Black and white image | Uneven color glossiness |
| Example 10 | Stainless steel web with 100 mesh | Silicone rubber 100 μm | FEP 15 μm | A | A | A |
| Example 1 | Stainless steel web with 100 mesh | None | FEP 15 μm | A | A | B |

When the fixation film of Example 1 having only a stainless steel web and release layer (FEP) was used for a color image fixation (especially when an entirely solid image such as a photograph was printed), the release layer failed to follow the irregularity of the toner and transfer material, and the resultant image had uneven glossiness.

When a fixation film having an elastic layer interposed between other layers, such as, the fixation film 10*c* of Example 10, the release layer could follow the irregularity of the toner and transfer material, and uniform glossiness could be achieved even in a color image fixation.

In Table 4 and subsequent Examples, criterion A for a black-and-white image means that no fixation defect occurs;

criterion A for color glossiness means that glossiness is uniform in a color image; and criterion B for color glossiness means that uneven glossiness partly occurs in a color image.

EXAMPLES 11 to 13

Studies were made on the thickness of a release layer of a fixation film in relation to quick start (energy saving), durability of a fixation film, and uneven glossiness in a color image.

Fixation films employed in Examples 11 to 13 have the same constitution as the fixation film 10*c* shown in FIG. 5. Table 5 lists the components of the fixation films and the results of fixation tests conducted with the fixation films set on an image heating apparatus.

TABLE 5

| | Components of fixation film | | | | Assessment of performance in actual use | | |
|---|---|---|---|---|---|---|---|
| | Substrate | Elastic layer | Release layer | Thickness of release layer (μm) | Quick start | Durability of release layer | Uneven color glossiness |
| Example 11 | Stainless steel web with 100 mesh | Silicone rubber 100 μm | FEP | 1 | A | C | A |
| Example 9 | Stainless steel web with 100 mesh | Silicone rubber 100 μm | FEP | 15 | A | A | A |
| Example 12 | Stainless steel web with 100 mesh | Silicone rubber 100 μm | FEP | 50 | A | A | A |
| Example 13 | Stainless steel web with 100 mesh | Silicone rubber 100 μm | FEP | 100 | C | A | B |

A stainless steel web (100 mesh, 0.1 mm wire diameter, 200 μm thick) was used as an exothermic layer serving as the substrate of a fixation film. A silicone rubber (hardness of rubber: 30° (JIS-A), heat conductivity: $1\times10^{-3}$ cal/cm·sec·deg., thickness: 100 μm) was used as an elastic layer.

A fixation test was conducted with the fixation film having the toner release layer of a fluororesin (FEP) and 1 μm thick provided on the elastic layer, which film was set on an image heating apparatus. Although the heat generation was sufficient, and quick start and energy saving were achieved, when 1000 sheets of A4-size recording paper had been passed, the release layer was worn out and toner offset phenomenon took place (Example 11).

Separately, a fixation test was conducted with the fixation film having a toner release layer of a fluororesin (FEP) and 100 μm thick provided on the elastic layer, which film was set on an image heating apparatus. As a result, a very large amount of energy was needed for transferring sufficient heat from the stainless steel web to a recording material and toner because of the heat insulation effect of the fluororesin. In addition, the hardness of the fluororesin of the release layer was high and it was as thick as 100 μm, so that the release layer could not follow the irregularity of the recording material or toner, and uneven glossiness occurred in a color image (Example 13).

In the cases of the fixation film in which the toner release layer of a fluororesin (FEP) and 15 μm thick was formed on the elastic layer (Example 9), and the fixation film in which the toner release layer of a fluororesin (FEP) and 50 μm thick was formed on the elastic layer (Example 12), heat energy generated from the stainless steel web was efficiently transferred to a recording material and toner, achieving quick start and energy saving, as well as a color image free from uneven glossiness. The release layer thereof was not worn out.

Therefore, the thickness of a release layer of a fixation film is preferably in a range from 1 to 100 μm In Table 5 and subsequent Examples, criterion A for quick start is that the surface temperature of the fixation film reaches 200° C. within one min;

criterion C for quick start is that it takes one min or longer for the surface temperature of the fixation film to reach 20° C.;

criterion A for durability of a release layer is that an offset phenomenon did not take place after 50000 sheets of A4-size transfer paper had been passed; and criterion C for durability of a release layer is that an offset phenomenon took place while 2000 to 5000 sheets of A4-size transfer paper were passed. Criterion A for durability of release layer is that toner offset did not occur when 50000 sheets of A4-sized transfer paper were passed. Criterion C for durability of release layer is that toner offset occurred when 2000–5000 sheets of A4-sized transfer paper were passed.

EXAMPLES 14 to 16

Studies were made on the thickness of an elastic layer of a fixation film in relation to quick start and uneven color glossiness.

Fixation films 10*c* employed in Examples 14 to 16 have the same constitution as shown in FIG. 5. Table 6 lists the components of the fixation films and the results of the tests on the fixation films set on an image heating apparatus.

TABLE 6

| | Components of fixation film | | | | Assessment of performance in actual use | |
|---|---|---|---|---|---|---|
| | Substrate | Elastic layer | Thickness of elastic layer (μm) | Release layer | Quick start | Uneven color glossiness |
| Example 14 | Stainless steel web of 100 mesh | Silicone rubber 100 μm | 50 | FEP 15 μm | A | B |
| Example 9 | Stainless steel web of 100 mesh | Silicone rubber 100 μm | 100 | FEP 15 μm | A | A |
| Example 15 | Stainless steel web of 100 mesh | Silicone rubber 100 μm | 500 | FEP 15 μm | A | A |
| Example 16 | Stainless steel web of 100 mesh | Silicone rubber 100 μm | 1000 | FEP 15 μm | B | A |

For each film, a stainless steel web (100 mesh, wire diameter of 0.1 mm, 200 μm thick) was used as the exothermic layer and substrate of the fixation film, and the toner release layer thereof was made of a fluororesin (FEP, 15 μm)

An elastic layer made of a silicone rubber (hardness of rubber: 30° (JIS-A), heat conductivity: $1\times10^{-3}$ cal/cm·sec·deg, thickness: 100 μm) was interposed between the stainless web and toner release layer (FEP), and studies were made varying the thickness of the elastic layer.

When the thickness of the elastic layer was 50 μm (Example 14), the heat generation was sufficient, and quick start and energy saving were achieved. For printing a color image, however, enough elasticity permitting the release layer to follow the irregularity of toner and the recording material could not be obtained. As a result, uneven glossiness occurred.

On the other hand, when the thickness of the elastic layer was 1000 μm (Example 16), elasticity due to the elastic layer was sufficient and uneven glossiness did not occur even in a color image, but a quite large amount of energy was needed for complete transfer of heat generated from the stainless web to a recording material and toner because of the heat insulation effect of the elastic layer. It was therefore difficult to achieve quick start and energy saving.

When the thickness of the elastic layer was 100 μm (Example 9) or 500 μm (Example 15), the fixation films proved to be able to efficiently transfer generated heat from the stainless steel web to a recording material and toner, to achieve quick start and energy saving. Also they could follow the irregularity of the toner and recording material owing to the effect of elasticity of the elastic layer, to produce a color image free from uneven glossiness.

In consideration of the aforesaid results of the test, the thickness of an elastic layer of a fixation film is preferably within a range from 50 to 1000 μm.

EXAMPLES 17 and 18

Studies were made on the relation between the readiness of curvature separation and the hardness of an elastic layer of a fixation film, as well as the relation between uneven glossiness in a color image and rigidity of the fixation film.

Fixation films employed in Examples 17 and 18 have the constitution (10*c*) as shown in FIG. 5. Table 7 lists the components of the fixation films and the results of a fixation test with the fixation films set on an image formation apparatus.

TABLE 7

| | Components of fixation film | | | | Assessment of performance in actual use | |
|---|---|---|---|---|---|---|
| | Substrate | Elastic layer | Hardness of elastic layer (JIS-A) | Release layer | Uneven color glossiness | Curvature separation |
| Example 17 | Stainless steel web of 100 mesh | Silicone rubber 100 μm | 60 | FEP 15 μm | B | B |
| Example 9 | Stainless steel web of 100 mesh | Silicone rubber 100 μm | 30 | FEP 15 μm | A | A |
| Example 18 | Stainless steel web of 100 mesh | Silicone rubber 100 μm | 20 | FEP 15 μm | A | A |

For each fixation film, a stainless steel web (100 mesh, wire diameter of 0.1 mm, thickness of 200 μm) was used as the exothermic layer and substrate of the fixation film, and a toner release layer thereof was made of a fluororesin (FEP, 15 μm).

With a fixation film in which an elastic layer made of a silicone rubber having a hardness of 60° (JIS-A) and a thickness of 100 μm was interposed between the stainless web and toner release layer (Example 17), since the hardness of the elastic layer was high, the release layer failed to follow the irregularity of toner and recording material. Consequently, uneven glossiness occurred in a color image.

By contrast, when an elastic layer made of a silicone rubber having a hardness of 30° (JIS-A) and a thickness of 100 μm was interposed between the stainless steel web and toner release layer (FEP) (Example 9), or an elastic layer made of a silicone rubber having a hardness of 20° (JIS-A) and a thickness of 100 μm was interposed (Example 18), the fixation film not only proved to be able to efficiently transfer the heat from the stainless steel web to the recording material and toner, to achieve quick start and energy saving, but could follow the irregularity of the toner and the recording material owing to the elasticity of the elastic layer, to produce a color image free from uneven glossiness.

Considering these results, it is known that the hardness of the rubber of an elastic layer of a fixation film is preferably 60° or less (JIS-A), or more preferably, 30° or less (JIS-A).

EXAMPLES 19 and 20

Studies were made on the heat conductivity of an elastic layer of a fixation film, quick start (energy saving), and uneven glossiness in a color image.

Each fixation film employed in Examples 17 and 18 has the constitution of the fixation film 10*c* shown in FIG. 5. Table 8 lists the components of the fixation films and the results of the fixation test with the fixation films set on an image heating apparatus.

TABLE 8

| | Components of fixation film | | | | Assessment of performance in actual use | |
|---|---|---|---|---|---|---|
| | Substrate | Elastic layer | Heat conductivity of elastic layer cal/cm · sec · deg | Release layer | Uneven color glossiness | Quick start |
| Example 19 | Stainless steel web of 100 mesh | Silicone rubber 100 μm | $6.0 \times 10^{-4}$ | FEP 15 μm | A | B |
| Example 9 | Stainless steel web of 100 mesh | Silicone rubber 100 μm | $1.0 \times 10^{-3}$ | FEP 15 μm | A | A |
| Example 20 | Stainless steel web of 100 mesh | Silicone rubber 100 μm | $1.5 \times 10^{-3}$ | FEP 15 μm | B | A |

For each fixation film, a stainless steel web (100 mesh, wire diameter of 0.1 mm, thickness of 200 μm) was used as the exothermic layer and substrate of the fixation film and the toner release layer thereof was made of a fluororesin (FEP, 15 μm) With a fixation film in which an elastic layer made of a silicone rubber having a heat conductivity of $6\times10^{-4}$cal/cm·sec·deg was interposed between the stainless steel web and toner release layer (FEP)(Example 19), since the heat conductivity of the elastic layer was very low, heat given off by the stainless steel web could not be efficiently transferred to a recording material and toner, and quick start and energy saving could not be achieved. In addition, since the toner could not be melted completely, defect s in fixation took place.

With a fixation film in which an elastic layer λ made of a silicone rubber having a heat conductivity of $1.5\times10^{-4}$ cal/cm·sec·deg was interposed between the stainless steel web and toner release layer (FEP)(Example 20), since the heat conductivity of the elastic layer was very high, the heat energy could be efficiently transferred to a recording material and toner, to achieve quick start and energy saving.

In general, as described above, when the heat conductivity of rubber is raised, the hardness of rubber becomes high. In the case of the silicone rubber employed in Example 20, the hardness rose to 58° (JIS-A) which is a limit hardness permitting the release layer to follow the irregularity of toner or a recording material because of the elasticity of the elastic layer.

Considering the aforesaid test results, it is known that the heat conductivity λ of a fixation film is preferably within a range from $6\times10^{-4}$ to $1.5\times10^{-3}$ cal/cm·sec·deg.

EXAMPLE 21

Figure 6:
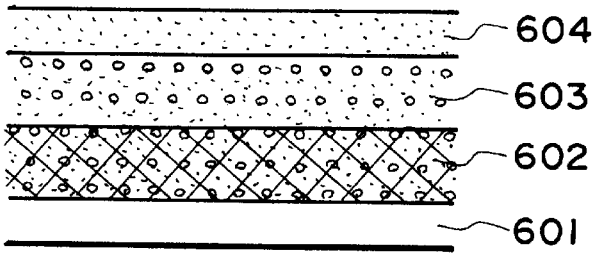
FIG. 6 is a schematic sectional view showing the structure of a fixation film employed in Example 21.

FIG. 6 is a sectional diagram of a fixation film employed in Example 21.

Reference numeral 602 denotes a stainless steel web serving as a substrate and exothermic layer of the fixation film. The opening size of the stainless steel web is 100 mesh. The diameter of each stainless steel wire constituting the web is 0.1 mm. The thickness of the stainless steel web is 200 μm.

Reference numeral 603 denotes an elastic layer made of a silicone rubber (hardness: 30° (JIS-A), heat conductivity: $1\times10^{-3}$ cal/cm·sec·deg). The thickness of the elastic layer is 100 μm. The stainless steel web 602 and elastic layer 603 are attached to each other using a silicone rubber primer. The stainless steel web has been impregnated with the same silicone rubber as used for elastic layer followed by curing.

Reference numeral 604 denotes a toner release layer made of a fluororesin (FEP). The thickness of the layer is 15 μm. The elastic layer 603 and release layer 604 are attached to each other using a primer.

Reference numeral 601 denotes an inward resin layer, in this case constituted of a PFA film of 50 μm thick, of the fixation film. The inward resin layer 601 is attached to the silicone rubber contained in the stainless steel web with a silicone rubber primer, and thus united with the stainless steel web.

With the increase in processing speed of image formation apparatuses, the rotation speed of a fixation film has become higher. Therefore, the inward surface of the fixation film and a film stay (guide) for supporting the fixation film from inward thereof may be worn down because they rub together. As a result, a trouble occurs in transport of a recording material leading to image defects.

When a slippery resin layer is formed on the inward surface of a fixation film as in Example 21, however, the inner side of the fixation film and the film stay are not abraded so much, to improve the durability of the high speed image formation apparatus (See Table 9).

TABLE 9

| | Components of fixation film | | | | Assessment of performance in actual use |
|---|---|---|---|---|---|
| | Inner resin layer | Substrate | Elastic layer | Release layer | Cutting of inner side of film and film stay |
| Example 21 | PFA 50 μm | Stainless steel web of 100 mesh | Silicone rubber 100 μm | FEP 15 μm | A |
| Example 9 | None | Stainless steel web of 100 mesh | Silicone rubber 100 μm | FEP 15 μm | B |

In Table 9, criterion A is that when 50000 sheets of A4-size transfer paper have been passed, no trouble occurs in transport of transfer paper due to the abrasion of the inner side of the film and the film stay; and criterion B is that when 10000 to 20000 sheets of A4-size transfer paper have been passed, a trouble occurs in transport of transfer paper due to the abrasion of the inner side of the film and the film stay.

EXAMPLE 22

Polyimide that is a resin of low rigidity was used for a substrate so as to realize a fixation film which is durable and suitable for curvature separation. The thickness of the polyimide layer was 50 μm.

A fluororesin (FEP) having excellent toner release ability was used for a release layer. The thickness of the fluororesin layer was 15 μm.

For the exothermic layer, a mixture of fine nickel particles (spherical) having good flux absorbency and a fluororesin primer was used (resin:magnetic substance=1:2 (by weight)). The thickness of the exothermic layer was 10 μm. The exothermic layer also serves as an adhesive between the polyimide layer serving as a substrate and the fluororesin (FEP) layer serving as a release layer.

The substrate, exothermic layer, and release layer were laminated in this order to give a toner fixation film of the present invention, and the film was set on the heating fixation apparatus shown in FIG. 2.

Fixation test was carried out using an electrophotographic color printer provided with the above heating fixation apparatus (FIG. 7). Toner could be successfully fixed onto a recording material owing to the heat generated by the exothermic layer. Since the exothermic layer of the toner fixation film came was located close to the boundary between a recording material and toner, energy efficiency was excellent and quick start of the fixation apparatus could be achieved.

At the same time, since a resin having low rigidity was used to produce a substrate instead of a metallic film, good curvature separation could be achieved.

EXAMPLE 23

A polyimide film (thickness: 50 μm) and fluororesin (FEP, thickness: 15 μm) were used to produce a substrate and release layer respectively as in Example 22.

A mixture of fine nickel particles (spherical) having excellent flux absorbency and a silicone rubber (rubber:magnetic substance=1:2 by weight)) was used to produce an exothermic layer. The thickness of the exothermic layer was 100 μm.

The substrate, exothermic layer, and release layer were laminated in this order to produce a toner fixation film of the present invention. The film was then set on the heating fixation apparatus shown in FIG. 2.

Fixation test was carried out using an electrophotographic color printer provided with the above heating fixation apparatus (FIG. 7). As a result, color images free from uneven glossiness could be obtained. Power consumption required for toner fixation was kept low, and quick start of the fixation apparatus could be achieved. As in Example 22, good curvature separation could be achieved.

EXAMPLE 24

A polyimide film (thickness: 50 μm) and fluororesin (FEP, thickness: 15 μm) were used to produce a substrate and release layer respectively as in Example 1.

A mixture of whisker-like fine barium sulfate particles coated by plating with nickel which is an excellent flux absorbent, and a silicone rubber (rubber:magnetic substance=5:8 (by weight)) was used to produce an exothermic layer. The thickness of the exothermic layer was 100 μm.

The substrate, exothermic layer, and release layer were laminated in this order to produce a toner fixation film of the present invention, and the film was set on the image fixation apparatus shown in FIG. 2.

Fixation test was carried out using an electrophotographic color printer provided with the above heating fixation apparatus (FIG. 7). Although the content of fine particles in the mixture is 80% of that in Example 23, fixation could be achieved with the same energy consumption as that in Example 23. Also, images free from uneven glossiness could be obtained. Furthermore, as in Example 22, good curvature separation could be achieved.

EXAMPLE 25

A polyimide film (thickness: 50 μm) and fluororesin (FEP, thickness: 15 μm) were used to produced a substrate and release layer respectively as in Example 22.

A mixture of fiber-like fine nickel particles (aspect ratio: 100) and a silicone rubber (rubber=magnetic substance=5:8

(by weight)) was used to produce an exothermic layer. The thickness of the exothermic layer was 100 μm.

The substrate, exothermic layer, and release layer were laminated in this order to produce a toner fixation film of the present invention, and the film was set on the heating fixation apparatus shown in FIG. 2.

Fixation test was carried out using an electrophotographic color printer provided with the above heating fixation apparatus (FIG. 7). Although the content of fine particles in the mixture was 80% of that in Example 23, fixation could be achieved with the same energy consumption as that in Example 23. Images free from uneven glossiness could be obtained. Furthermore, as in Example 22, good curvature separation could be achieved.

EXAMPLE 26

A polyimide film (thickness: 50 μm) and fluororesin (FEP, thickness: 15 μm) were used to produce a substrate and release layer respectively as in Example 22.

A mixture of nickel-coated fiber-like fine carbon particles and a silicone rubber (rubber:magnetic substance=1:2 (by weight)) was used to produce an exothermic layer. The thickness of the exothermic layer was 100 μm.

The substrate, exothermic layer, and release layer were laminated in this order, to produce a toner fixation film of the present invention, and the film was set on the heating fixation apparatus shown in FIG. 2.

Fixation test was carried out using an electrophotographic color printer provided with the above heating fixation apparatus (FIG. 7). Although the content of fine particles in the mixture was 70% of that in Example 23, fixation could be achieved with the same energy consumption as that in Example 23. Image free from uneven glossiness could be obtained. Moreover, similarly to Example 22, good curvature separation could be achieved.

EXAMPLE 27

A polyimide film (thickness: 50 μm) and fluororesin (FEP, thickness: 15 μm) were used to produce a substrate and release layer respectively as in Example 22.

Fine nickel particles was mixed into a silicone rubber and then carbon was mixed to control the volume resistivity to $1\times10^6$ Ω·cm (rubber:magnetic substance=1:2 (by weight)) to produce an exothermic layer. The thickness of the exothermic layer was 100 μm.

The substrate, exothermic layer, and release layer were laminated in this order to produce a toner fixation film of the present invention, and the film was set on the heating fixation apparatus shown in FIG. 2.

Fixation test was carried out using an electrophotographic color printer provided with the above heating fixation apparatus (FIG. 7). Toner fixation could be achieved with the energy consumption that was smaller by approximately 20% than that required in Example 23. Images free from uneven glossiness could be produced. Furthermore, similarly to Example 22, good curvature separation could be attained.

EXAMPLE 28

An electroformed nickel film that is a metallic film having excellent flux absorbency was used as a substrate. The thickness of the film (or layer) is 50 μm which is larger than the skin depth (σ) given by the expression (1).

A fluororesin (FEP) having excellent toner release ability was used to produce a release layer. The thickness of the fluororesin layer was 15 μm.

A mixture of fine nickel particles and a fluororesin primer (rubber magnetic substance=1:2 (by weight)) was used to produce an exothermic layer. The thickness of the exothermic layer was 10 μm. The exothermic layer also serves as an adhesive between the electroformed nickel film serving as the substrate and the fluororesin (FEP) layer serving as the release layer.

The substrate, exothermic layer, and release layer were laminated in this order to produce a toner fixation film of the present invention, and the film was set on the heating fixation apparatus shown in FIG. 2.

Fixation test was carried out using an electrophotographic color printer provided with the above heating fixation apparatus (FIG. 7). Compared with the conventional toner fixation film comprised of an electroformed nickel film (thickness: 50 μm) laminated with a fluororesin primer (thickness: 10 μm) and fluororesin (thickness: 15 μm), energy consumption could be reduced by approximately 20%.

EXAMPLE 29

An electroformed nickel film (thickness: 50 μm) and a fluororesin (FEP, thickness: 15 μm) were used to produce a substrate and release layer respectively as in Example 28.

A mixture of fine nickel (spherical) particles having excellent flux absorbency and a silicone rubber (rubber:magnetic substance=1:2 (by weight)) was used to produce an exothermic layer. The thickness of the exothermic layer was 100 μm.

The substrate, exothermic layer, and release layer were laminated in this order to produce a toner fixation film of the present invention, and the film was set on a heating fixation apparatus shown in FIG. 2.

Fixation test was carried out using an electrophotographic color printer provided with the above heating fixation apparatus (FIG. 7). Compared with the conventional toner fixation film comprised of an electroformed nickel film (thickness: 50 μm) laminated with a silicone rubber (thickness: 100 μm) and fluororesin (thickness: 15 μm), energy consumption could be reduced by approximately 20%. Furthermore, color images free from uneven glossiness could be obtained.

EXAMPLE 30

An electroformed nickel film (thickness: 50 μm) and fluororesin (FEP, thickness: 15 μm) were used to produce a substrate and release layer respectively as in Example 28.

A mixture of whisker-like fine barium sulfate particles plated with nickel having excellent flux absorbency, and a silicone rubber was used to produce an exothermic layer (rubber:magnetic substance=5:8 (by weight)). The thickness of the exothermic layer was 100 μm.

The substrate, exothermic layer, and release layer were laminated in this order to produce a toner fixation film of the present invention, and the film was set on a heating fixation apparatus shown in FIG. 2.

Fixation test was carried out using an electrophotographic color printer provided with the above heating fixation apparatus (FIG. 7). Although the content of fine particles in the mixture was 80% of that in Example 29, fixation could be achieved with the same energy consumption as in Example 29. Furthermore, images free from uneven glossiness could be obtained.

EXAMPLE 31

An electroformed nickel film (thickness: 50 μm) and a fluororesin (FEP, thickness: 15 μm) were used to produce a substrate and release layer respectively as in Example 28.

A mixture of fiber-like fine nickel particles (aspect ratio: 100) and a silicone rubber (rubber magnetic substance=5:8 (by weight)) was used to produce an exothermic layer. The thickness of the exothermic layer was 100 μm.

The substrate, exothermic layer, and release layer were laminated in this order to produce a toner fixation film of the present invention, and the film was set on the heating fixation apparatus shown in FIG. 2.

Fixation test was carried out using an electrophotographic color printer provided with the above heating fixation apparatus (FIG. 7). Although the content of fine particles in the mixture was 80% of that in Example 29, fixation could be achieved with the same energy consumption as in Example 29. Moreover, images free from uneven glossiness could be obtained.

EXAMPLE 32

An electroformed nickel film (thickness: 50 μm) and fluororesin (FEP, thickness: 15 μm) were used to produce a substrate and release layer as they were in Example 28.

A mixture made by mixing fiber-like fine carbon particles coated with nickel in a silicone rubber (rubber:magnetic substance=5:7 (by weight)) was used to produce an exothermic layer. The thickness of the exothermic layer was 100 μm.

The substrate, exothermic layer, and release layer were laminated in this order to produce a toner fixation film of the present invention, and the film was set on the heating fixation apparatus shown in FIG. 2.

Fixation test was carried out using an electrophotographic color printer provided with the above heating fixation apparatus (FIG. 7). Although the content of fine particles in the mixture was 70% of that in Example 29, fixation could be achieved with the same energy consumption as in Example 29. Further, images free from uneven glossiness could be obtained.

EXAMPLE 33

An electroformed nickel film (thickness: 50 μm) and fluororesin (FEP, thickness: 15 μm) were used to produce a substrate and release layer respectively as in Example 28.

Fine nickel particles and a silicone rubber were mixed and then carbon was added to control the volume resistivity to $1\times10^{6}$ Ω·cm to produce an exothermic layer. The thickness of the exothermic layer was 100 μm.

The substrate, exothermic layer, and release layer were laminated in this order to produce a toner fixation film of the present invention, and the film was set on the heating fixation apparatus shown in FIG. 2.

Fixation test was carried out using an electrophotographic color printer provided with the above heating fixation apparatus (FIG. 7). Fixation could be achieved with the energy consumption smaller by about 20% than that in Example 29. Furthermore, images free from uneven glossiness could be obtained

What is claimed is:

1. A toner fixation film comprising a release layer and an exothermic layer which generates heat when an eddy current is induced therein with application of a magnetic field, wherein said exothermic layer comprises a metallic web impregnated with a resin, wherein an elastomeric layer is formed between said exothermic layer and said release layer, and said elastomeric layer comprises the same resin as the exothermic layer.

2. A toner fixation film according to claim 1, wherein the exothermic layer comprises two or more of said metallic webs laminated together.

3. A toner fixation film according to claim 1, wherein said metallic web has openings of from 50 to 600 mesh.

4. A toner fixation film according to claim 1 wherein the release layer comprises the same resin as the exothermic layer.

5. A toner fixation film according to claim 2, wherein the thickness of said elastomeric layer ranges from 50 to 1000 μm.

6. A toner fixation film according to claim 2, wherein the hardness of said elastomeric layer is 60° or smaller (JIS-A).

7. A toner fixation film according to claim 2, wherein the heat conductivity λ of said elastomeric layer ranges from $6\times10^{-4}$ to $1.5\times10^{-3}$ cal/cm·sec·deg.

8. A toner fixation apparatus comprising:

a fixation film comprising an exothermic layer being in press-contact with a pressing member;

at least one coil for generating an alternating magnetic field to induce eddy currents in the exothermic layer of said fixation film; wherein a recording material holding an unfixed toner image thereon is held and transported between said fixation film and said pressing member for toner fixation, wherein said exothermic layer comprises a metallic web having openings of from 50 to 600 mesh impregnated with a resin.

9. A toner fixation apparatus according to claim 8, wherein the exothermic layer comprises two or more of said metallic webs laminated together.

10. A toner fixation apparatus according to claim 8, wherein a release layer is formed on said exothermic layer, and the release layer comprises the same resin as the exothermic layer.

11. A toner fixation apparatus according to claim 10, wherein an elastomeric layer is formed between said exothermic layer and said release layer, and said elastomeric layer comprises the same resin as the exothermic layer.

12. A toner fixation apparatus according to claim 11, wherein the thickness of said elastomeric layer ranges from 50 to 1000 μm.

13. A toner fixation apparatus according to claim 11, wherein the hardness of said elastomeric layer is 60° or smaller (JIS-A).

14. A toner fixation apparatus according to claim 11, wherein the heat conductivity of said elastomeric layer ranges from $6\times10^{-4}$ to $1.5\times10^{-3}$ cal/cm·sec·deg.

* * * * *

UNITED STATES PATENT AND TRADEMARK OFFICE

CERTIFICATE OF CORRECTION

PATENT NO. : 5,939,337

DATED : August 17, 1999

INVENTOR(S): HIDEYUKI HATAKAYAMA, ET AL.

It is certified that error appears in the above-identified patent and that said Letters Patent is hereby corrected as shown below:

COLUMN 1,
Line 25, "has discloses" should read --discloses--.
COLUMN 3,

Line 56, "effective" should read --necessary--.
COLUMN 4,
Line 34, "generated" should read --is generated--;
Line 46, "leads" should read --lead--; and
Line 66, "ranges" should read --and ranges--.
COLUMN 5,
Line 1, "adhesivity" should read --adhesiveness--.
COLUMN 6,
Line 56, "an" should read --a--; and
Line 58, "an" should be deleted.
COLUMN 8,
Line 14, "$10_a$set" should read --$10_a$ set--.
COLUMN 14,
Line 30, "20°C.;" should read --200°C.;--; and
Line 65, "passed. Criterion" should read --passed. Criterion--.
COLUMN 17,
Line 62, "15 μm) With" should read --15 μm). With--.

UNITED STATES PATENT AND TRADEMARK OFFICE

CERTIFICATE OF CORRECTION

PATENT NO. : 5,939,337

DATED : August 17, 1999

INVENTOR(S): HIDEYUKI HATAKEYAMA, ET AL. Page 2 of 2

It is certified that error appears in the above-identified patent and that said Letters Patent is hereby corrected as shown below:

COLUMN 18,
Line 3, "defect s" should read --defects--.
COLUMN 19,
Line 37, "Polyimide" should read --Polyimide,--.
COLUMN 20,
Line 64, "produced" should read --produce--.

Signed and Sealed this

Sixth Day of June, 2000

*Attest:*

Q. TODD DICKINSON

*Attesting Officer*

*Director of Patents and Trademarks*